United States Patent [19]

Umemura et al.

[11] Patent Number: 4,485,744

[45] Date of Patent: Dec. 4, 1984

[54] METAL PALLET

[75] Inventors: Akihiro Umemura, Nagoya; Hisayoshi Kunii; Michiyasu Shimizu, both of Sagamihara; Yoshinari Sato, Yokohama, all of Japan

[73] Assignee: Tokyo Shibaura Denki Kabushiki Kaisha, Japan

[21] Appl. No.: 399,869

[22] Filed: Jul. 19, 1982

[51] Int. Cl.[3] ..... B65D 19/28

[52] U.S. Cl. ..... 108/51.1

[58] Field of Search ..... 108/51.1, 56.1, 57.1, 108/52.1, 56.3, 53.1

[56] References Cited

U.S. PATENT DOCUMENTS

| | | | |
|---|---|---|---|
| 2,615,661 | 10/1952 | Cushman | 108/52.1 |
| 2,930,560 | 3/1960 | Carnwath et al. | 108/56.1 |
| 3,294,041 | 12/1966 | Lessheim | 108/51.1 |
| 3,602,157 | 8/1971 | Cohen | 108/57.1 |
| 3,861,326 | 1/1975 | Brown | 108/51.1 |
| 4,112,854 | 9/1978 | Pitchford | 108/51.1 |

FOREIGN PATENT DOCUMENTS

| | | | |
|---|---|---|---|
| 2333811 | 3/1974 | Fed. Rep. of Germany | 108/51.1 |
| 54-16090 | 6/1979 | Japan . | |
| 55-89063 | 7/1980 | Japan . | |
| 219713 | 3/1968 | Sweden | 108/51.1 |

*Primary Examiner*—William E. Lyddane
*Assistant Examiner*—Mark W. Binder
*Attorney, Agent, or Firm*—Cushman, Darby & Cushman

[57] ABSTRACT

A metal pallet of this invention comprises a plurality of longitudinal frames each including a pair of metal plate members each having a plurality of furrows formed along the longitudinal direction thereof and a plurality of support members interposed between the metal plate members to couple the same vertically, the longitudinal frames being arranged parallel to one another, and a plurality of transverse frames each having a plurality of furrows formed along the longitudinal direction thereof and arranged parallel to one another on the upper surfaces of the longitudinal frames at right angles thereto.

3 Claims, 3 Drawing Figures

METAL PALLET

BACKGROUND OF THE INVENTION

This invention relates to a metal pallet.

Heretofore, wooden pallets have been widely used. When transporting in a container the wooden pallets loaded with products to be exported, however, the water contained in the pallets will evaporate as the ambient temperature rises. Dew would then form as the temperature falls. The dew thus formed would sometimes rust the products held on the pallets. Accordingly, dew-free metal pallets have recently come into general use, although they still involve many drawbacks, such as being heavy, expensive, and difficult to handle.

SUMMARY OF THE INVENTION

This invention was developed in consideration of these circumstances, and its object is to provide a metal pallet which is suitably strong despite its being light and easy to handle.

According to this invention, there is provided a metal pallet which comprises a plurality of longitudinal frames each including a pair of metal plate members each having a plurality of furrows formed along the longitudinal direction thereof and a plurality of support members interposed between the metal plate members to couple the same vertically, the longitudinal frames being arranged parallel to one another at predetermined intervals, and a plurality of transverse frames each having a plurality of furrows formed along the longitudinal direction thereof and arranged parallel to one another on the upper surfaces of the longitudinal frames at right angles thereto.

DETAILED DESCRIPTION OF THE PREFERRED EMBODIMENT

A metal pallet according to an embodiment of this invention will now be described which is used for a cathode-ray tube to be shipped abroad, with reference to the accompanying drawings.

Figure 1:
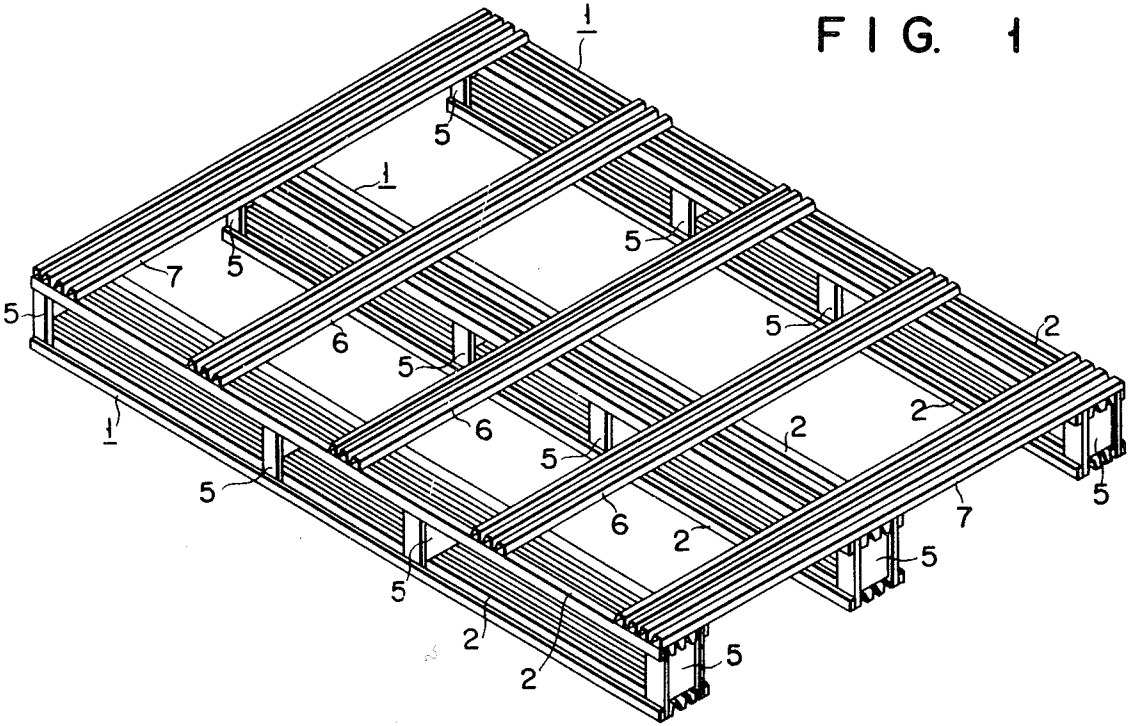
FIG. 1 is a perspective view of a metal pallet according to this invention.
Figure 2:
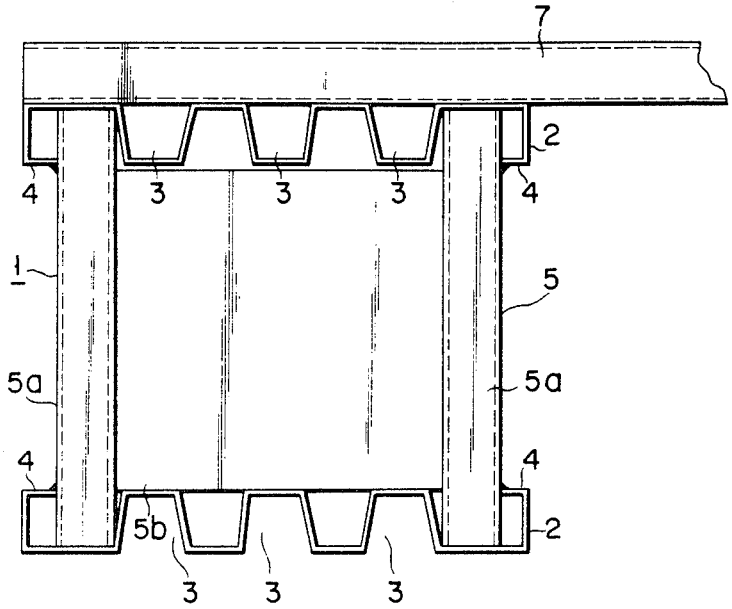
FIG. 2 is a front view of a corner section of the metal pallet.
Figure 3:
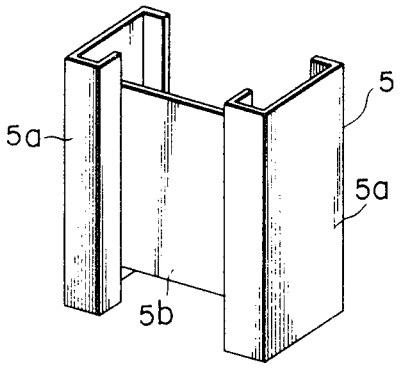
FIG. 3 is a perspective view of a support member.

In FIG. 1, a numeral 1 designates longitudinal frames which are each composed of a pair of metal plate members 2 coupled vertically by means of a plurality of support members 5 interposed between them. Each metal plate member 2 is a corrugated sheet having two ridges and three furrows 3, as shown in FIG. 2. The members 2 are made by slitting a galvanized iron sheet into long strips and roll-forming the strips into corrugated sheets. The long strips are then bent so that channel portions 4 are formed at both longitudinal edge portions. The furrows 3 are gradually narrowed toward the bottom. Each support member 5, as shown in FIG. 3, is composed of a central flat plate portion **5*b* made of a stamped-out, galvanized iron sheet and channel-shaped support portions 5*a* integrally formed by bending and facing each other on both sides of the flat plate portion 5*b*. The longitudinal frame 1 is formed by opposing the back sides of the pair of metal plate members 2 to each other, interposing the support members 5 between the upper and lower metal plate members 2 at both end portions and two central portions, and spot-welding the end edges of the respective pairs of channel portions 4 of the two metal members 2 to the lateral faces of the support portions 5*a* of the support members 5, respectively. Numerals 6 and 7 designate transverse frames which are made in the same manner as the longitudinal frames 1, except that the frames 7** each have three ridges and four furrows.

As shown in FIG. 1, the three longitudinal frames 1 are arranged with spaces between them for the insertion of forks of a fork lift truck. A plurality of transverse frames 6 and 7 are stretched at right angles to the longitudinal frames 1 and spaced at substantially regular intervals. The frames 6 and 7 are spot-welded to the upper surfaces of the longitudinal frames 1. In this case, the transverse frames 7 with four furrows are arranged at the front and rear end portions of the longitudinal frames 1, while the transverse frames 6 with three furrows are arranged at the central portion of the longitudinal frames 1.

In the metal pallet of this invention constructed in this manner, metal plates are used for the longitudinal frames 1 and the transverse frames 6 and 7 as the structural components. A plurality of furrows are formed along the longitudinal direction of each frame. Thus, the pallet is of light weight, as well as of desirable compressive and bending strength. For example, a pallet with longitudinal frames 1 measuring 100 mm in height and 1,400 mm in length and transverse frames 6 and 7 measuring 1,100 mm in length was manufactured by using a galvanized iron sheet with a thickness of 0.6 mm. As a result, the pallet weighed approximately 12 kg as compared with a wooden pallet of the same size weighing about 25 kg. Thus, the cost of the metal pallet can be reduced. In addition, the metal pallet is much easier to handle. Moreover, it can be very easily manufactured since its components, including the metal plate members 2, the support members 5, the transverse frames 6 and 7, are formed by being rolled or bent, and then welded together.

Since the metal plate members 2 and the transverse frames 6 and 7 are each formed by rolling the long strips made of a slit galvanized iron sheets, pallets of different lengths or of different sizes can be manufactured by using the same bending die. Moreover, the metal plate members 2 and the transverse frames 6 and 7 arranged at right angles on the upper surface of the pallet have respective furrows, so that a product or products loaded on the pallet may be prevented from making a skid during transfer. If rain falls on the pallet, it can be made to flow down the furrows and drained by tilting the pallet. Moreover, being made of galvanized iron sheets, the pallet will hardly rust.

What we claim is:

1. A metal pallet comprising:

a plurality of longitudinal frames arranged parallel to one another at predetermined separated intervals each said frame including a pair of opposing metal plate members, each said plate member having a plurality of furrows formed along the longitudinal direction thereof and channel portions defined on each longitudinal side thereof;

first and second pairs of support members interposed between each respective pair of metal plate members to couple and separate the plate members of each pair vertically, each said support member of said first pair being rigidly fixed between said pair of plate members at respective ends of said plate members and each said support member of said second pair being rigidly fixed between said pair of plate members at locations intermediate of said first pair of support members, each said support member of said first and second pairs including a pair of separated channel posts having opposing ends accepted in opposing ones of said channel portions and a central plate member rigidly fixed between and bridging said separated pair of channel posts; and plural transverse metal plate frames each having a plurality of furrows formed along the longitudinal direction thereof and arranged parallel to one another on the upper surfaces of said longitudinal frames at right angles thereto.

2. The metal pallet according to claim 1, wherein the metal plates constituting said longitudinal and transverse frames are galvanized iron sheets.

3. The metal pallet according to claim 1 wherein said second pair of support members are rigidly fixed at a location nearer to a center of said plate member pair than to a respective one of said support members of said first pair at said respective end of said plate member pair.

* * * * *